US005109924A

United States Patent [19]

Jürgens et al.

[11] Patent Number: 5,109,924

[45] Date of Patent: May 5, 1992

[54] ONE TRIP WINDOW CUTTING TOOL METHOD AND APPARATUS

[75] Inventors: Rainer Jürgens; Dietmar Krehl, both of Celle, Fed. Rep. of Germany

[73] Assignee: Baker Hughes Incorporated, Houston, Tex.

[21] Appl. No.: 628,235

[22] Filed: Dec. 17, 1990

[30] Foreign Application Priority Data

Dec. 22, 1989 [DE] Fed. Rep. of Germany ..... 3942438

[51] Int. Cl.[5] ..... E21B 7/08; E21B 29/06

[52] U.S. Cl. ..... 166/117.5; 166/117.6; 175/61; 175/391

[58] Field of Search ..... 175/61, 79, 81, 82, 175/391; 166/117.5, 117.6

[56] References Cited

U.S. PATENT DOCUMENTS

| | | | |
|---|---|---|---|
| 2,020,471 | 11/1935 | Layne | 255/1 |
| 2,105,722 | 1/1938 | Barrett et al. | 175/81 |
| 2,216,963 | 10/1940 | Sinclair | 255/1 |
| 2,509,144 | 6/1950 | Grable et al. | 255/1.6 |
| 2,667,332 | 1/1954 | McCune et al. | 255/1.6 |
| 2,882,015 | 4/1959 | Beck | 166/117.6 |
| 3,115,935 | 12/1963 | Hooton | 166/117.6 |
| 3,116,799 | 1/1964 | Lemons | 175/61 |
| 3,397,746 | 8/1968 | Link | 166/117.6 |
| 3,908,759 | 9/1975 | Cagle et al. | 166/117.6 |
| 4,031,974 | 6/1977 | Peterson | 175/391 X |
| 4,266,621 | 5/1981 | Brock | 175/329 |
| 4,285,399 | 8/1981 | Holland et al. | 166/113 |
| 4,304,299 | 12/1981 | Holland et al. | 166/255 |
| 4,397,355 | 8/1983 | McLamore | 166/297 |
| 4,765,404 | 8/1988 | Bailey et al. | 166/117.6 |

*Primary Examiner*—Terry Lee Melius
*Attorney, Agent, or Firm*—Michael Polacek

[57] ABSTRACT

The present invention pertains to a device and method for drilling a secondary or deflection hole from a cased drill hole in underground rock or geologic formations. The device disclosed herein includes a deflection wedge unit mountable via a packer in the drill hole and a pilot cutting tool, all mountable to a drill string. A deflection guide actuated by deflection ramp on the deflection wedge unit initiates the deflection drilling process.

9 Claims, 2 Drawing Sheets

ONE TRIP WINDOW CUTTING TOOL METHOD AND APPARATUS

BACKGROUND OF THE INVENTION

The present invention pertains to a device and method for drilling a secondary or deflection hole from a cased hole in underground rock or geologic formations.

In preparation of a conventional deflection hole or window, a packer is oriented in the drill hole and a diverter wedge unit, including a wedge surface, is mounted on the packer by an anchor device. The deflection wedge unit is usually attached to a pilot window milling tool by a shear bolt linkage and is inserted into the drill hole with the drill string bearing the pilot milling tool. The conventionally employed tool includes a frontal cone oriented towards the deflection wedge unit. The cone forms a deflection guide cooperating with the deflection wedge surface of the deflection wedge unit. After shearing off the bolt joint, the pilot milling tool cuts a window in the tube wall region as the cone is diverted downward.

Once the cone, however, runs past the deflection wedge surface, the pilot milling tool's frontal cutting surface remains located directly above the deflection wedge unit and thus would destroy the deflection wedge unit upon further downward motion. The drill string must then be pulled, equipped with a different cutting tool, and reinserted. Furthermore, any additional cutting work needed to perfect the window, such as milling, widening, and clearing of the same also requires the pulling of the drill string and equipping it with new cutting tools before relowering it. This may take place several times and the attendant work and assembly effort is considerable.

SUMMARY OF THE INVENTION

The present invention discloses a device and method that can produce a deflection hole or window much more easily, quickly, and cost effectively.

In the present invention, the deflection guide is positioned along the drill string, directly behind the pilot cutting tool. The pilot cutting tool is in such a position in the drill hole that its frontal cutting surface does not come to rest over the deflection wedge unit after the window cutting step is initiated so that the deflection wedge surface can take over the guidance of the tool without the deflection wedge unit being destroyed. Therefore, the pilot cutting tool does not need to be replaced at that time and pulling of the drill string is not necessary. The resulting time and cost savings is considerable.

Additional cutting/milling tools can also be included in the present drill string design in order to further cut out and/or expand the window, to conduct clearing work, or to complete the overall deflection hole or window with the same drill string, until work can continue with a standard drilling apparatus.

A preferred design of the invention disclosed herein include a deflection wedge unit including a deflection ramp cooperating with the drill string mounted pilot cutting tool deflection guide. This ramp holds the pilot cutting tool in its starting position. The pilot cutting tool's deflection guide can be formed by a conical tool holder section or starter cone mounted behind it along the drill string. Any other cutting tools such as a milling tool with a greater cutting diameter, as compared to the diameter of the pilot cutting tool, with which the drill hole window can be expanded can be designed as part of the connected drill string. Yet a further clearing tool with an even greater cutting diameter can be mounted adjacent the milling tool. Similarly, it is possible to provide additional cutting/milling tools if a particular need arises.

DETAILED DESCRIPTION OF THE INVENTION

Figure 1:
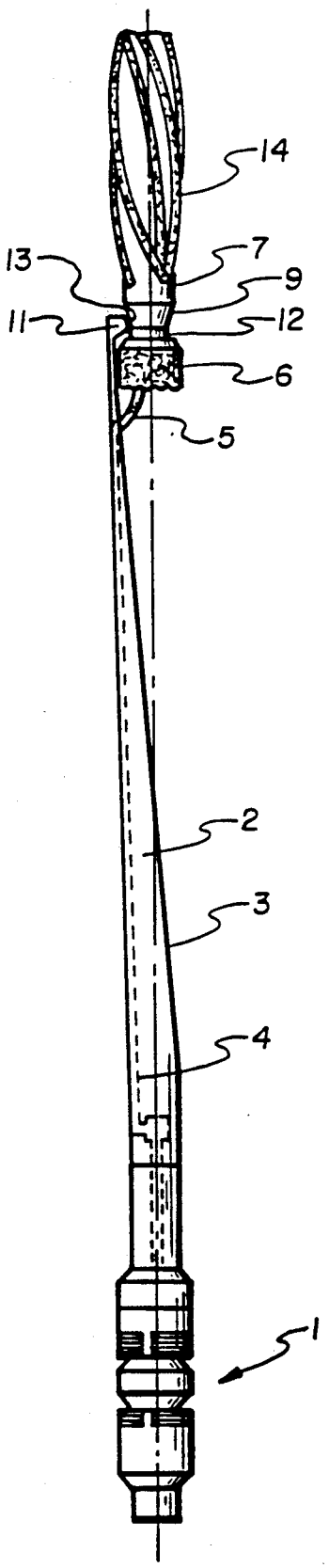
FIG. 1 shows a partially cut-away, schematic illustration of the lower and central portions of one embodiment of the present invention.
Figure 2:
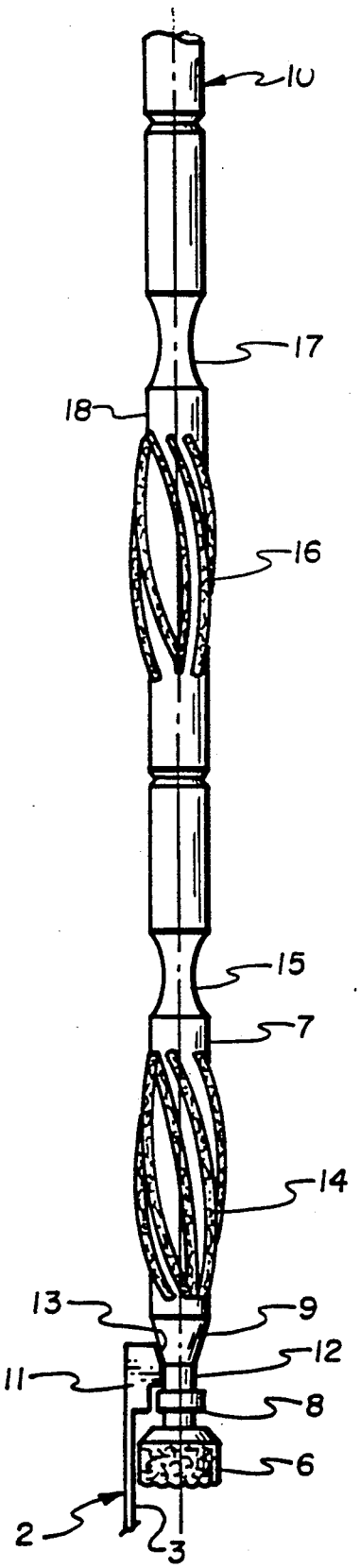
FIG. 2 shows a partially cut-away, schematic illustration of the drill string and the upper and central portions of the embodiment shown in FIG. 1.

The present invention will now be described in greater detail and with specific reference to the accompanying drawings. With reference now to FIGS. 1 and 2, one embodiment of the present invention is shown.

As shown in FIG. 1, the apparatus disclosed by the present invention is comprised in part of an anchor packer 1 and a deflection wedge unit 2 which includes a deflection wedge surface 3. The packer 1 and deflection wedge unit 2 are designed as a complete unit or assembly and are generally set together in the drill hole. The deflection wedge unit 2, with its deflection wedge surface 3, as shown, has a deflection or diversion angle of about 2° to 3° . The deflection wedge surface 3 is comprised of an annealed, high-performance steel so that the pilot cutting tool 6 can be safely directed along it without destroying the wedge unit 2. The deflection wedge unit 2 is linked directly with the packer 1 and includes a hydraulic passage 4 in order to facilitate the setting of the packer 1 in the drill hole.

Moreover, the deflection wedge unit 2 also includes a hydraulic line 4 whose upper end is joined to a hose 5 with a coupling (not shown). The hose 5 is joined to the pilot cutting tool 6 and thus creates a direct link to the drilling fluid supply.

As illustrated in greater detail in FIG. 2, the pilot cutting tool 6 is mounted to the drill string 10 at its end region 8 and proximate milling tool 7. The leading end of milling tool 7 includes the deflection guide 9 for the pilot cutting tool 6. This deflection guide or starter cone 9 is of a generally conical shape.

The deflection wedge unit 2, at its upper end near the drill string 10, includes a deflection ramp 11 which retains the pilot cutting tool 6. The connection between the deflection ramp 11 and the pilot cutting tool 6 is established by a shear bolt connection, generally designated by reference numeral 12, in order to permit the setting and positioning of the deflection wedge unit 2 and the packer 1 with respect to the drill string 10 and the pilot cutting tool 6.

The deflection ramp 11 includes a deflection ramp surface 13 and, at the beginning of the deflection or window cutting process, the lower region of the deflection guide 9 rests against it. In the pilot cutting or deflection starting position, the deflection guide 9 extends over the deflection ramp surface 13 so that the pilot cutting tool 6 can be pivoted via the deflection guide 9 and the deflection ramp surface 13 of the deflection ramp 11 away from the drill hole longitudinal axis without first coming into contact with the deflection wedge surface 3 of the deflection wedge unit 2.

The milling unit 14 of tool 7 which is mounted above the pilot cutting tool 6 generally has an outer cutting diameter that is greater than the outer diameter of the pilot cutting tool 6. A constriction 15 is included above the milling unit 14 in the first downstream cutting tool 7 forming a flex joint so that the tool 7 can be bent to a certain extent and thereby reduce any material stresses due to torsion.

Another tool 18 follows tool 7 and the tool 18 also includes a milling unit 16. The tool 18 also includes a constriction or flex joint 17 and is thus also of a locally flexible design in order to reduce any material stresses that occur. The milling unit 16 of tool 18 generally has a cutting outer diameter that essentially corresponds to the required diameter of the finished deflection hole or window being prepared, and thus forms a clearing cutting tool. Of course, other cutting tools or milling units can be provided between the clearing cutting tool 18 and the rest of the drill string 10 if the clearing capacity of tool 18 is not sufficient for a particular job.

Figure 3:
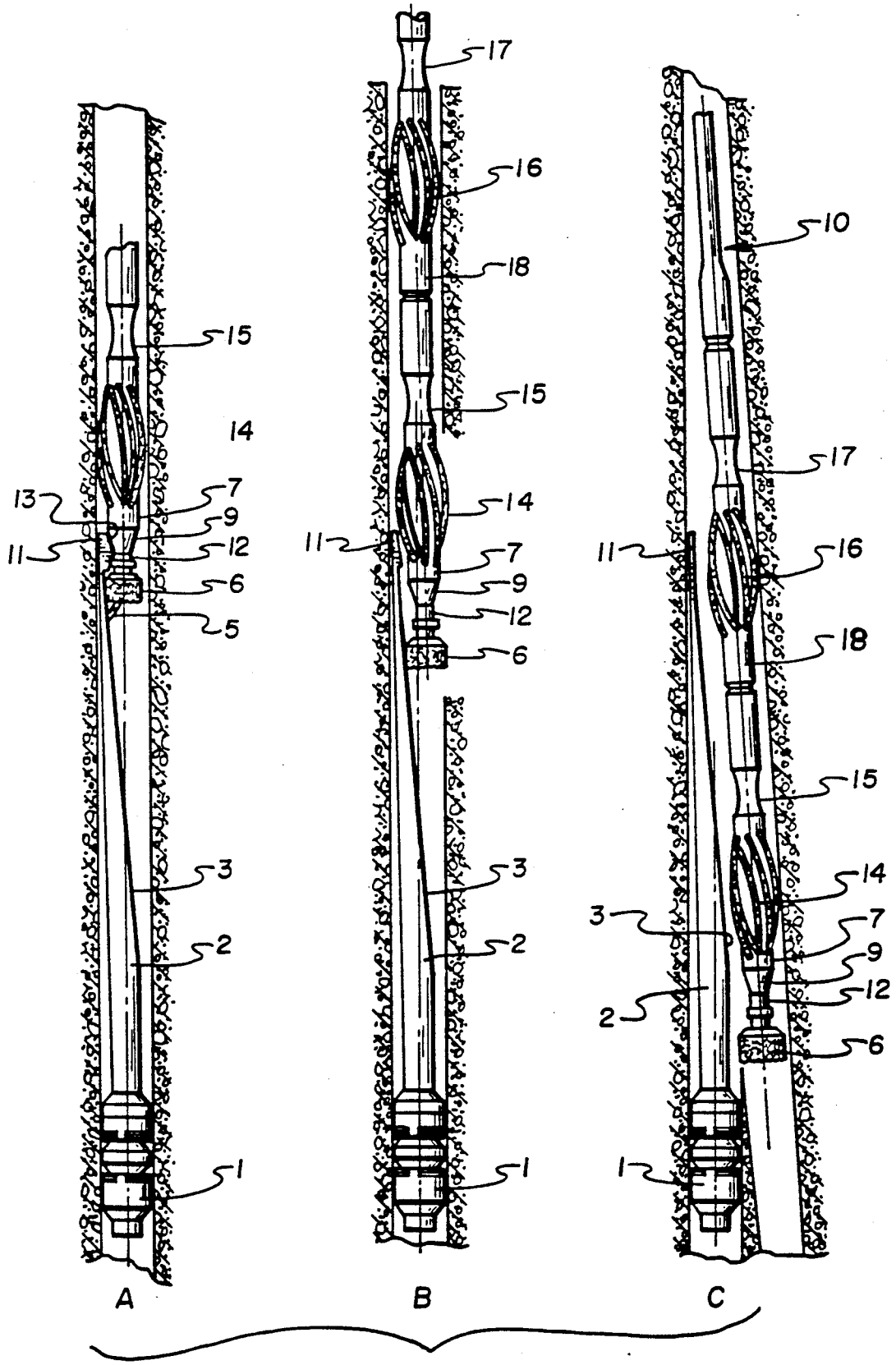
FIGS. 3A–3C show a partially cut-way, schematic illustration of the embodiment shown in FIGS. 1 and 2 in various stages of operation.

As shown in FIGS. 3A-3C, the complete packer/deflection wedge unit including drilling tools 6, 7 and 18 is mounted at the lower end of the drill string 10 and the deflection wedge unit 2 and the drilling units 6, 7 and 18 are aligned as desired. The packer 1, deflection wedge unit 2, and the drilling tools 6, 7 and 18 are then lowered into the drill hole. Once the desired depth is reached, the deflection wedge unit 2 is aligned with respect to the drill hole and the packer 1 is set via overpressure from the hydraulic passage 4 (See FIG. 1) of the deflection wedge unit 2.

Next, the linkage shear bolts (not specifically shown) connecting the pilot cutting tool 6 and deflection unit 2 via the deflection ramp 11 are sheared off, whereupon the device is ready for the deflection or window cutting step. The cutting tool unit is then rotated and the pilot cutting tool 6 initiates the cutting of a window in the drill hole wall during its downward motion as the deflection guide 9 moves downward along the deflection ramp surface 13 of the deflection ramp 11. As the cutting tool unit is rotated and moved downwardly, the tool pilot 6 eventually comes into contact with the deflection wedge surface 3 of the deflection wedge unit 2 (FIG. 3A). This initial guidance by the deflection ramp 11 ensures that the deflection wedge unit 2 is not damaged in its upper region by the pilot cutting tool 6, but rather that the pilot cutting tool 6 properly initiates the required window cut.

Once the deflection guide 9 moves past the deflection ramp 11, the milling unit 14 of milling tool 7 mills the deflection ramp 11 partially away, and also expands the window in the drill hole wall which was cut by the pilot cutting tool 6 (FIG. 3B). The pilot cutting tool 6 is now being guided by the deflection wedge surface 3 of the deflection wedge unit 2. The pilot tool 6 can slide smoothly along the deflection wedge surface 3 which is generally comprised of annealed, high performance steel, without causing it any damage. In order to catch any metal cuttings from the cutting tool drilling fluid returns flusher, it can be useful to employ magnetic rods (not shown). Depending on the drilling progress, the RPMs and the weight on bit can be slowly increased.

After additional drilling progress, the pilot cutting tool 6 will have the casing wall directly under it. This situation can be noticed by a reduced torque with a simultaneous decline in the drilling progress. The weight on bit should then be increased until the pilot cutting tool 6 has penetrated the drilled casing hole wall completely (FIG. 3C). The window region is subsequently expanded and cleared with the milling unit 16 mounted on cutting tool 18, and the pilot cutting tool 6 drills faster into the formation until the cutting tool 18 has completely passed the casing wall region.

It can be useful to partially retract the drill string 10 in the formation after each meter or so of drilling progress to further clear the drill hole wall window. Before running a standard drilling apparatus through the window, it is also useful to expand the window region of the drilled hole wall, or perhaps first to remove any remaining debris, which can also be performed with the device disclosed herein and its cutting tools 6, 7 and 18. Once the milling or cutting work of the window in the drill hole wall is completed, the drill string 10 can be replaced by a standard drilling apparatus.

In the foregoing specification, this invention has been described with reference to a specific exemplary embodiment thereof. It will, however, be evident that various modifications and changes may be thereunto without departing from the broader spirit and scope of the invention as set forth in the appended claims. The specification and drawings included herein are, accordingly, to be regarded in an illustrative rather than in a restrictive sense.

What is claimed Is:

1. A device for drilling a deflection hole or window from a drill hole in underground rock or geologic formations, said device comprising a deflection wedge unit mountable via a packer in the drill hole, and a pilot cutting tool mounted to the lower end of a drill string, said drill string including a conically shaped deflection guide along said drill string behind said tool, said guide cooperating with a deflection ramp formed proximate the upper end of the deflection wedge unit which deflects the guide and thereby the tool in order to initiate the window cutting process, said deflection wedge unit eventually guiding said tool and said drill string including one or more later cutting tools.

2. A device according to claim 1, wherein one or more of said one or more later cutting tools are designed to be locally flexible.

3. A device according to claim 2, wherein said locally flexible later cutting tools include a constriction along their axis.

4. A device according to claim 1, wherein the packer and the deflection wedge unit are designed as a single assembly installable in the drill hole.

5. A device according to claim 1, wherein the deflection wedge unit is comprised of annealed, high-performance steel.

6. A device according to claim 1, wherein the deflection ramp is at least partially millable by one or more of said later cutting tools.

7. A device according to claim 1, wherein the deflection wedge unit and the pilot cutting tool are positionable with respect to each other for orienting and setting them as a unit in the drill hole via a shear bolt connection between the pilot cutting tool and the deflection ramp of the deflection wedge unit.

8. A device according to claim 4, wherein the deflection wedge unit includes a hydraulic passage to said packer and a hydraulic connection with the pilot cutting tool.

9. A method of drilling a deflection hole or window from a drill hole in an underground rock or geologic formation comprising the steps of:

providing a packer and deflection wedge unit including a deflection ramp, a drill string mounted pilot cutting tool, and a drill string mounted conically shaped deflection guide behind said tool for cooperating with said deflection ramp;

setting said packer and deflection wedge unit within said drill hole while positioning said pilot cutting tool within said hole and above said deflection wedge by having its deflection guide cooperating with said deflection ramp;

rotating said pilot cutting tool while guiding said tool downwardly by said deflection guide over said deflection ramp thereby initiating a window cut from said drill hole without the pilot cutting tool engaging said deflection wedge;

allowing said pilot cutting tool to come into contact with said deflection wedge for further guiding said pilot cutting tool; and further milling and clearing of said window with one or more successive cutting tools mounted as part of said drill string.

* * * * *